US009664434B2

(12) United States Patent
Leong et al.

(10) Patent No.: US 9,664,434 B2
(45) Date of Patent: May 30, 2017

(54) EVAPORATIVE CONDENSATE DISSIPATION SYSTEM

(71) Applicant: Hill Phoenix, Inc., Conyers, GA (US)

(72) Inventors: Chin Hoong Leong, Fairfield, IA (US); Gregory A. Hoernig, Fairfield, IA (US); Michael H. Kauk, Cantril, IA (US); Leo W. Powell, Keosauqua, IA (US); Andrew P. Mueller, Fairfield, IA (US); Marvin L. Thomas, Milton, IA (US)

(73) Assignee: Hill Phoenix, Inc., Conyers, GA (US)

( * ) Notice: Subject to any disclaimer, the term of this patent is extended or adjusted under 35 U.S.C. 154(b) by 382 days.

(21) Appl. No.: 14/287,941

(22) Filed: May 27, 2014

(65) Prior Publication Data

US 2015/0342371 A1 Dec. 3, 2015

(51) Int. Cl.

| | |
|---|---|
| ***F25D 21/06*** | (2006.01) |
| ***F25D 21/14*** | (2006.01) |
| *A47F 3/04* | (2006.01) |

(52) U.S. Cl.

CPC ..... *F25D 21/14* (2013.01); *A47F 3/0495* (2013.01); *F25D 2321/141* (2013.01); *F25D 2321/1412* (2013.01)

(58) Field of Classification Search

CPC ..... F25D 21/14; F25D 2321/1412; F25D 2321/141; F25D 21/08; F25D 2321/1413; F25D 2321/1442; F25D 2321/145; A47F 3/0495; A47F 3/0482; A47F 3/0404

See application file for complete search history.

(56) References Cited

U.S. PATENT DOCUMENTS

| | | | | |
|---|---|---|---|---|
| 2,296,997 A | | 9/1942 | Knoy | |
| 2,343,246 A | | 3/1944 | Schechter et al. | |
| 2,555,968 A | | 6/1951 | Harbison | |
| 2,912,171 A | * | 11/1959 | Merrick | B01F 3/04035 118/DIG. 16 |
| 3,280,580 A | | 10/1966 | Costantini et al. | |
| 3,696,632 A | | 10/1972 | Carlin et al. | |

(Continued)

OTHER PUBLICATIONS

Final Office Action received in U.S. Appl. No. 13/280,202, dated Dec. 3, 2013, 11 pages.

(Continued)

*Primary Examiner* — Len Tran
*Assistant Examiner* — Ana Vazquez
(74) *Attorney, Agent, or Firm* — Foley & Lardner LLP

(57) ABSTRACT

An evaporative condensate dissipation system includes a receptacle configured to receive and accumulate a liquid condensate from a cooling element of a refrigeration system, a rotating element (e.g., an array of plates, a rotating drum, etc.) disposed at least partially within the receptacle such that a portion of the rotating element is submerged in the liquid condensate, and a motor configured to cause the rotating element to rotate such that a portion of the rotating element is periodically submerged in the liquid condensate and emerged from the liquid condensate. A fan may be used to provide an airflow across a surface of the rotating element to increase expedite evaporative dissipation. The fan and/or motor may be operably controlled by a switch or sensor responsive to a level of the liquid condensate accumulated in the receptacle.

11 Claims, 10 Drawing Sheets

(56) References Cited

U.S. PATENT DOCUMENTS

| | | | | |
|---|---|---|---|---|
| 4,136,529 | A * | 1/1979 | McCarty | F24F 13/224 165/60 |
| 4,513,584 | A * | 4/1985 | Woyke | F25B 15/02 62/235.1 |
| 4,766,737 | A | 8/1988 | Baxter, II | |
| 5,570,587 | A | 11/1996 | Kim | |
| 5,694,785 | A | 12/1997 | Balentine | |
| 5,706,669 | A * | 1/1998 | Lee | F25D 21/14 261/80 |
| 6,167,716 | B1 | 1/2001 | Fredrick | |
| 6,360,548 | B1 | 3/2002 | Navarro | |
| 6,363,736 | B1 * | 4/2002 | Kunkel | F25D 21/14 248/247 |
| 6,895,770 | B1 | 5/2005 | Kaminski | |
| 7,032,406 | B2 | 4/2006 | Hollen et al. | |
| 7,278,274 | B2 | 10/2007 | Kim | |
| 7,418,827 | B2 | 9/2008 | Rios | |
| 2002/0000093 | A1 | 1/2002 | Lea | |
| 2007/0000273 | A1 | 1/2007 | Sanders | |
| 2008/0256974 | A1 | 10/2008 | Verma et al. | |
| 2011/0042047 | A1 | 2/2011 | Karl et al. | |
| 2011/0174009 | A1 * | 7/2011 | Iizuka | F04D 25/06 62/305 |
| 2012/0006044 | A1 * | 1/2012 | Kim | F25D 21/14 62/280 |

OTHER PUBLICATIONS

Non-Final Office Action received in U.S. Appl. No. 13/280,202, dated Jun. 24, 2014, 12 pages.

Non-Final Office Action Received in U.S. Appl. No. 13/280,202, dated Oct. 22, 2013, 9 pages.

* cited by examiner

EVAPORATIVE CONDENSATE DISSIPATION SYSTEM

BACKGROUND

The present invention relates generally to the field of temperature-controlled display devices (e.g. refrigerated display devices or cases, etc.) having a temperature-controlled space for storing and displaying products such as refrigerated foods or other perishable objects. More specifically, the present invention relates to a refrigerated display case having an active evaporative condensate dissipation system for vaporizing liquid condensate (e.g., melted frost or ice from a cooling coil).

It is well known to provide a temperature-controlled display device (e.g., a refrigerator, freezer, refrigerated merchandiser, refrigerated display case, etc.) that may be used in commercial, institutional, and residential applications for storing or displaying refrigerated or frozen objects. For example, it is known to provide service type refrigerated display cases for displaying fresh food products (e.g., beef, pork, poultry, fish, etc.) in a supermarket or other commercial setting.

Such refrigerated cases typically include cooling elements (e.g. cooling coils, heat exchangers, evaporators, etc.) that receive a coolant (e.g. a liquid such as a glycol-water mixture, a refrigerant, etc.) from a cooling system (e.g., a refrigeration system) during a cooling mode or operation to provide cooling to the temperature-controlled space. The cooling system may operate to provide coolant to the cooling element at a temperature below 32° F., thereby causing moisture from the air in the ambient environment to condense on the cooling element, and resulting in an accumulation of frost and/or ice on an exterior surface of the cooling element.

The frost and/or ice can be removed (e.g. melted) during a defrost mode or operation. The melted frost and/or ice (e.g. liquid condensate, water, etc.) from the cooling coil is usually routed to a suitable drain at or near the case's location. However, for implementations in which a drain is not conveniently accessible at the location of the refrigerated case, it may be necessary to allow the liquid condensate to accumulate in a suitable repository or receptacle. The repository may be configured for removal to permit manually disposing the liquid condensate (e.g. by pouring down a remote drain, etc.), or the repository may be configured to simply contain the liquid condensate until it dissipates by evaporation.

Previous evaporative dissipation systems have a number of deficiencies. For example, previous systems tend to overflow or spill when the rate of liquid condensate generated from defrosting exceeds the rate at which the liquid condensate can dissipate. This situation is exacerbated as ambient humidity rises because more defrosting of the cooling element is required, but less of the condensate evaporates in the humid conditions. It would be desirable to provide a refrigerated display device or case with an improved evaporative condensate dissipation system that overcomes these and other disadvantages.

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

SUMMARY

One implementation of the present disclosure is a temperature-controlled display device including a temperature-controlled space configured for storing and displaying products and a refrigeration system having a compressor and a cooling element. The compressor is configured to circulate a refrigerant through the cooling element to provide cooling for the temperature-controlled space. The temperature-controlled display device includes an evaporative condensate dissipation system configured to receive a liquid condensate from an external surface of the cooling element and to dissipate the liquid condensate by evaporation. The evaporative condensate dissipation system includes a receptacle configured to accumulate the liquid condensate received from the cooling element, a rotating element disposed at least partially within the receptacle such that a portion of the rotating element is submerged in the liquid condensate accumulated in the receptacle, and a motor configured to cause the rotating element to rotate such that a portion of the rotating element is periodically submerged in the liquid condensate accumulated in the receptacle and emerged from the liquid condensate accumulated in the receptacle. In some embodiments, the receptacle has a depth approximately equal to a radius of the rotating element.

In some embodiments, the temperature-controlled display device includes a bearing attached to the receptacle and an axle having a first end supported by the bearing, a second end rotatably coupled to the motor, and a middle portion extending between the bearing and the motor over the liquid condensate accumulated in the receptacle. The axle may be fixedly attached to the rotating element such that rotation of the axle causes a corresponding rotation of the rotating element.

In some embodiments, the rotating element includes one or more plates configured to rotate about an axis of rotation substantially parallel to an upper surface of the liquid condensate accumulated in the receptacle. Each of the one or more plates may include a central opening configured to fix the plate to the axle and a plurality of satellite holes configured to rotate about the central opening as the plate rotates about the axle.

In some embodiments, the rotating element includes an array of plates arranged in parallel and concentrically aligned along the axle. The axle may divine an axis of rotation for the array of plates. Each of the plates has a plate thickness. The plates may be offset from each other along the axle by an offset distance having a value between the plate thickness and ten times the plate thickness.

In some embodiments, the rotating element is a cylindrical drum configured to rotate about an axis of rotation substantially parallel to an upper surface of the liquid condensate accumulated in the receptacle.

In some embodiments, the temperature-controlled display device includes a sensor configured to indicate a level of the liquid condensate accumulated in the receptacle. The motor may be operably controlled in response to the level of the liquid condensate indicated by the sensor.

In some embodiments, the temperature-controlled display device includes a fan configured to cause an airflow across a surface of the rotating element.

In some embodiments, the temperature-controlled display device includes a heat exchanger configured to receive a hot gas refrigerant supply from the compressor and to transfer heat from the hot gas refrigerant supply into the liquid condensate accumulated in the receptacle.

Another implementation of the present disclosure is an evaporative condensate dissipation system including a receptacle configured to receive and accumulate a liquid condensate from a cooling element of a refrigeration system, a rotating element disposed at least partially within the receptacle such that a portion of the rotating element is submerged in the liquid condensate accumulated in the receptacle, and a motor configured to cause the rotating element to rotate such that a portion of the rotating element is periodically submerged in the liquid condensate accumulated in the receptacle and emerged from the liquid condensate accumulated in the receptacle.

In some embodiments, the evaporative condensate dissipation system includes a bearing attached to the receptacle and an axle having a first end supported by the bearing, a second end rotatably coupled to the motor, and a middle portion extending between the bearing and the motor over the liquid condensate accumulated in the receptacle. The axle may be fixedly attached to the rotating element such that rotation of the axle causes a corresponding rotation of the rotating element.

In some embodiments, the rotating element includes one or more plates arranged in parallel and concentrically aligned along an axle rotatably coupled to the motor. The one or more plates may be fixed to the axle and configured to rotate about an axis of rotation defined by the axle. The axis of rotation may be substantially parallel to an upper surface of the liquid condensate accumulated in the receptacle.

In some embodiments, each of the one or more plates includes a central opening configured to fix the plate to the axle extending through the central opening and a plurality of satellite holes configured to rotate about the central opening as the plate rotates about the axis of rotation.

In some embodiments, the rotating element is a cylindrical drum configured to rotate about an axis of rotation substantially parallel to an upper surface of the liquid condensate accumulated in the receptacle.

In some embodiments, the evaporative condensate dissipation system includes a sensor configured to indicate a level of the liquid condensate accumulated in the receptacle. The motor may be operably controlled in response to the level of the liquid condensate indicated by the sensor.

In some embodiments, the evaporative condensate dissipation system includes a fan configured to cause an airflow across a surface of the rotating element.

In some embodiments, the evaporative condensate dissipation system includes a heat exchanger configured to receive a hot gas refrigerant supply from the compressor and to transfer heat from the hot gas refrigerant supply into the liquid condensate accumulated in the receptacle.

Another implementation of the present disclosure is a cascaded evaporative condensate dissipation system including a first stage receptacle configured to receive and accumulate a liquid condensate from a cooling element of a refrigeration system. The first stage receptacle includes a first overflow device. The cascaded evaporative condensate dissipation system further includes a rotating element disposed at least partially within the first stage receptacle such that a portion of the rotating element is submerged in the liquid condensate accumulated in the receptacle, a motor configured to cause the rotating element to rotate such that a portion of the rotating element is periodically submerged in the liquid condensate accumulated in the first stage receptacle and emerged from the liquid condensate accumulated in the first stage receptacle, a second stage receptacle configured to receive and accumulate the liquid condensate from the first stage receptacle when a level of the liquid condensate in the first stage receptacle reaches the first overflow device; a first heating element disposed at least partially within the second stage receptacle.

In some embodiments, the second stage receptacle comprises a second overflow device. The cascaded evaporative condensate dissipation system may further include a third stage receptacle configured to receive and accumulate the liquid condensate from the second stage receptacle when a level of the liquid condensate in the second stage receptacle reaches the second overflow device and a second heating element disposed at least partially within the third stage receptacle.

In some embodiments, the first heating element is a heat exchanger configured to receive a hot gas refrigerant supply from a compressor of the refrigeration system and to transfer heat from the hot gas refrigerant supply into the liquid condensate accumulated in the second stage receptacle. In some embodiments, the second heating element is an electric heating element operably controlled by a switch responsive to a level of the liquid condensate in the third stage receptacle.

The foregoing is a summary and thus by necessity contains simplifications, generalizations, and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Referring generally to the FIGURES, an evaporative condensate dissipation system is shown, according to an exemplary embodiment. The evaporative condensate dissipation system described herein may be implemented in conjunction with a temperature-controlled display device (e.g., a refrigerator, freezer, refrigerated merchandiser, refrigerated display case, etc.) to vaporize a liquid condensate. The liquid condensate may result from condensation on a cooling element (e.g., a cooling coil, a heat exchanger, an evaporator, etc.) of the temperature-controlled display device. For example, moisture in the ambient environment of the temperature-controlled display device may condense on the cooling element, resulting in a liquid condensate or an accumulation of frost and/or ice. The frost and/or ice can be melted (e.g., by operating the temperature-controlled display device in a defrost mode) to generate liquid condensate.

The evaporative condensate dissipation system includes a receptacle (e.g., a pan) configured to receive or collect the liquid condensate from the cooling element. The evaporative condensate dissipation system further includes a rotatable element such as a cylindrical drum or one or more rotatable plates (e.g., a disc, an array of discs, etc.). In some embodiments, the plates are perforated, porous, or otherwise configured to maximize the surface area of the plates. The rotatable element may be coupled to a motor configured to cause the rotatable element to rotate.

The rotatable element may be partially submerged in the liquid condensate in the receptacle. Operating the motor may cause a portion of the rotatable element to be periodically submerged in the liquid condensate and emerged from the liquid condensate. As the rotatable element is rotated, one or more surfaces of the rotatable element may become wetted as a result of the periodic submersion in the liquid condensate. Advantageously, the increase in wetted surface area provided by the rotatable element facilitates an expedited evaporative dissipation of the liquid condensate.

In some embodiments, the evaporative condensate dissipation system includes a fan configured to cause air movement across the rotatable element. The fan may be an existing component of the temperature-controlled display device (e.g., a compressor fan, a condenser fan, etc.) or an additional component. In some embodiments, the evaporative condensate dissipation system uses heat generated by the compressor or condenser of the temperature-controlled display device to increase the rate of evaporative dissipation.

Figure 1:
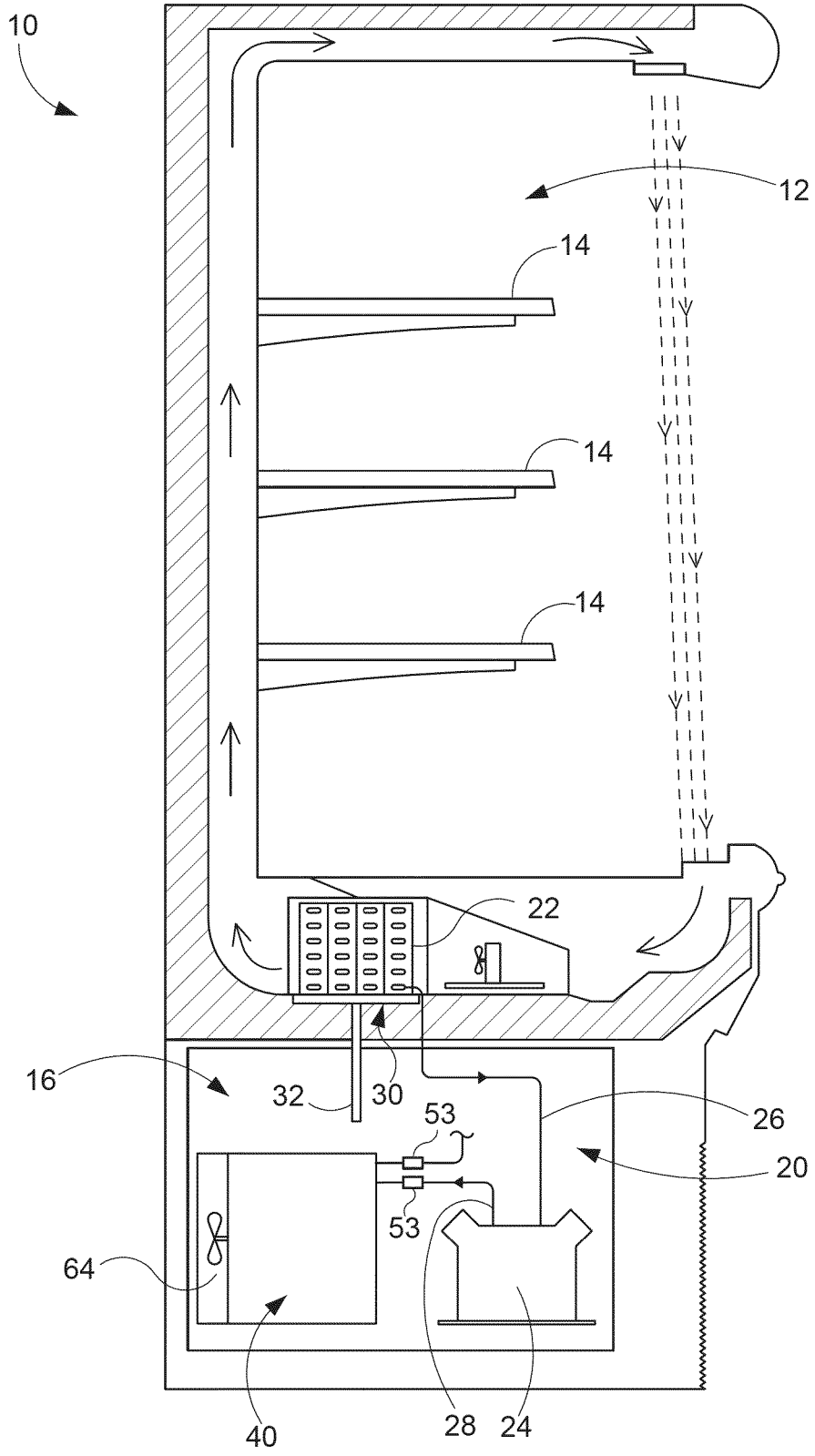
FIG. 1 is a drawing of a temperature-controlled display device having an evaporative condensate dissipation system, according to an exemplary embodiment.

Referring now to FIG. 1, a temperature-controlled display device 10 is shown, according to an exemplary embodiment. Temperature controlled-display device 10 may be a refrigerator, a freezer, a refrigerated merchandiser, a refrigerated display case, or other device capable of use in a commercial, institutional, or residential setting for storing and/or displaying refrigerated or frozen objects. For example, temperature-controlled display device 10 may be a service type refrigerated display case for displaying fresh food products (e.g., beef, pork, poultry, fish, etc.) in a supermarket or other commercial setting.

Temperature-controlled display device 10 is shown to include a temperature-controlled space 12 having a plurality of shelves 14 for storage and display of products therein. In various embodiments, temperature-controlled display device 10 may be an open-front refrigerated display case (as shown in FIG. 1) or a closed-front display case. An open-front display case may use a flow of chilled air that is discharged across the open front of the case to help maintain a desired temperature within temperature-controlled space 12. A closed-front display case may include one or more doors for accessing food products or other items stored within temperature-controlled space 12.

Temperature-controlled display device 10 is shown to include a refrigeration system 20 having a cooling element 22 (e.g. an evaporator, a cooling coil, a fan-coil, a heat exchanger, etc.). Cooling element 22 receives a coolant (e.g. a refrigerant, etc.) from refrigeration system 20 during a cooling mode of operation. In the cooling mode of operation, cooling element 22 may operate at a temperature lower than the temperature of the air within temperature-controlled space 12 to provide cooling to temperature-controlled space 12 (e.g., by absorbing heat from the air surrounding cooling element 22). As the air surrounding cooling element 22 is cooled, moisture in the air may condense on an external surface of cooling element 22 due to the cooler air having a decreased vapor pressure (e.g., a lesser ability to hold water vapor).

In some embodiments, cooling element 22 operates at a temperature lower than the freezing point of water (e.g., below 32° F.), resulting in an accumulation of frost and/or ice on an external surface of cooling element 22 during operation in the cooling mode. In some embodiments, refrigeration system 20 is configured to operate in a defrost mode. In the defrost operating mode, cooling element 22 may be heated to melt any accumulated frost and/or ice into a liquid condensate (e.g. water, etc.). The heat of defrosting may be provided by any suitable method such as interrupting the cooling mode and allowing ambient temperature to melt the frost/ice, using electric heating elements, or routing a hot gas refrigerant through cooling element 22.

Still referring to FIG. 1, refrigeration system 20 is shown to include a compressor 24. Compressor 24 may be configured to draw returning refrigerant from cooling element 22 through a suction line 26 and to discharge the refrigerant in a superheated hot gas state through a discharge line 28. In some embodiments, refrigeration system 20 includes one or more additional components such as a condenser (e.g., to condense the hot gas refrigerant discharged from compressor 24), an expansion device (e.g., to expand the condensed refrigerant to a low pressure, low temperature state for use by cooling element 22), a valve or other pressure-regulating device, a temperature sensor, a controller, a fan, and/or other components commonly used in refrigeration systems.

Temperature-controlled display device 10 is shown to include a compartment 16 located beneath the cooling element 22 and the temperature-controlled space 12. In various embodiments, compartment 16 may be located beneath temperature-controlled space 12, behind temperature-controlled space 12, above temperature-controlled space 12, or otherwise located with respect to temperature-controlled space 12. Compartment 16 may contain components of refrigeration system 20 such as compressor 24, a condenser, an expansion valve, a controller, a fan, etc.

Still referring to FIG. 1, temperature-controlled display device 10 is shown to include an evaporative condensate dissipation system 40. In some embodiments, evaporative condensate dissipation system 40 is located in compartment 16. System 40 may receive liquid condensate from an external surface of cooling element 22. System 40 may receive the liquid condensate either directly (e.g., by catching condensate droplets from cooling element 22) or indirectly (e.g., via drip pan 30 and drain line 32). Drain line 32 may deliver the liquid condensate to a receptacle of evaporative condensate dissipation system 40 (described in greater detail with reference to FIGS. 2A-2C).

Evaporative condensate dissipation system 40 may be configured to dispose of the liquid condensed on cooling element 22 without requiring access to a drain line or other traditional forms of liquid disposal. In some embodiments, evaporative condensate dissipation system 40 is packaged as a single unit that can be readily installed (e.g. in a plug-and-play type manner) in a wide variety of temperature-controlled display devices. Advantageously, evaporative condensate dissipation system 40 may be readily installed or removed from a temperature-controlled display device to adapt the temperature-controlled display device for use in various implementations regardless of access to drainage.

Figure 2A:
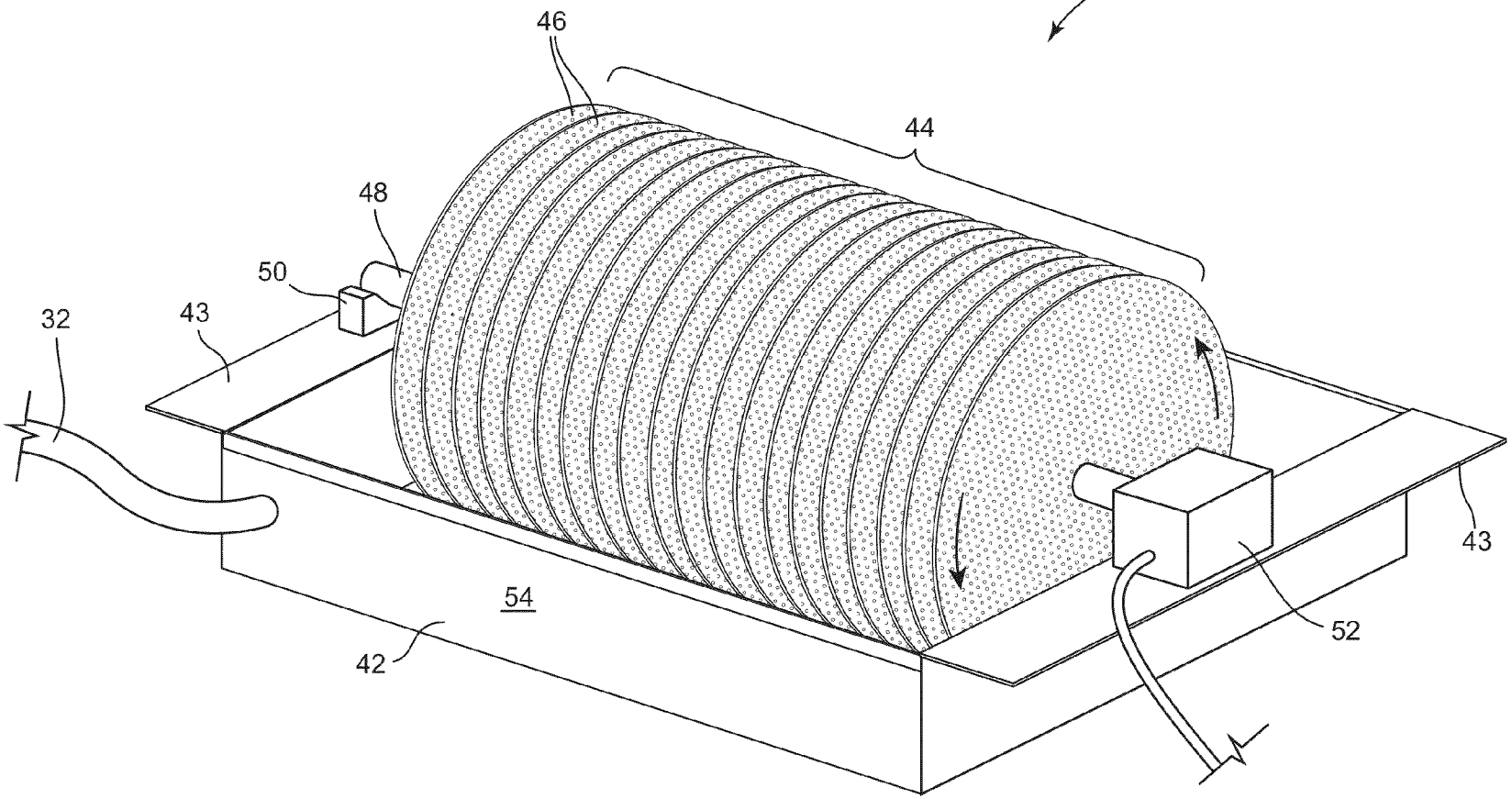
FIG. 2A is a drawing illustrating the evaporative condensate dissipation system of FIG. 1 in greater detail, according to an exemplary embodiment in which the evaporative condensate dissipation system includes an array of rotating plates.
Figure 2B:
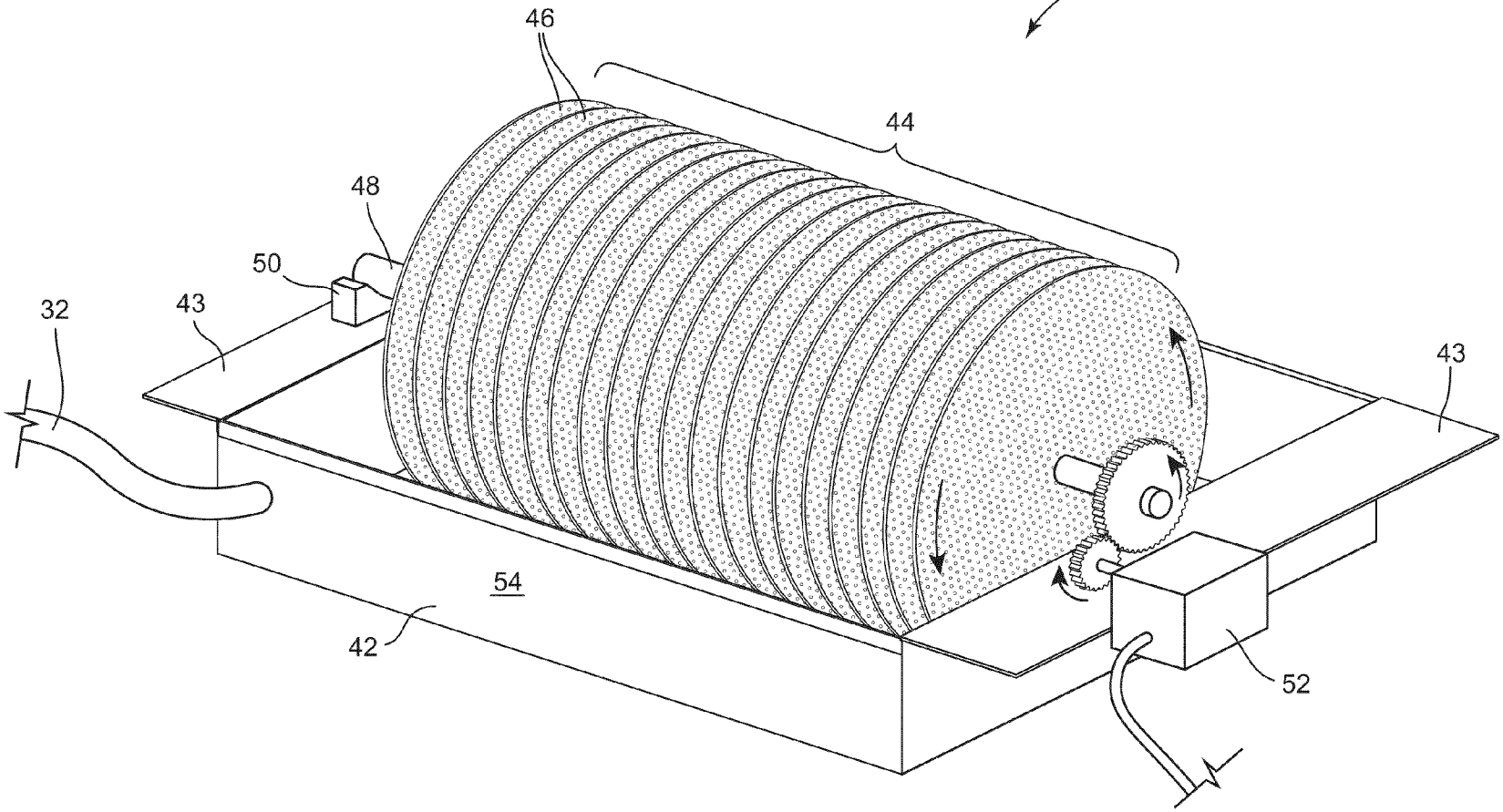
FIG. 2B is a drawing illustrating the evaporative condensate dissipation system of FIG. 1 in greater detail, according to another exemplary embodiment in which the array of rotating plates is rotatably coupled with a motor via a gearing arrangement and a central axle.
Figure 2C:
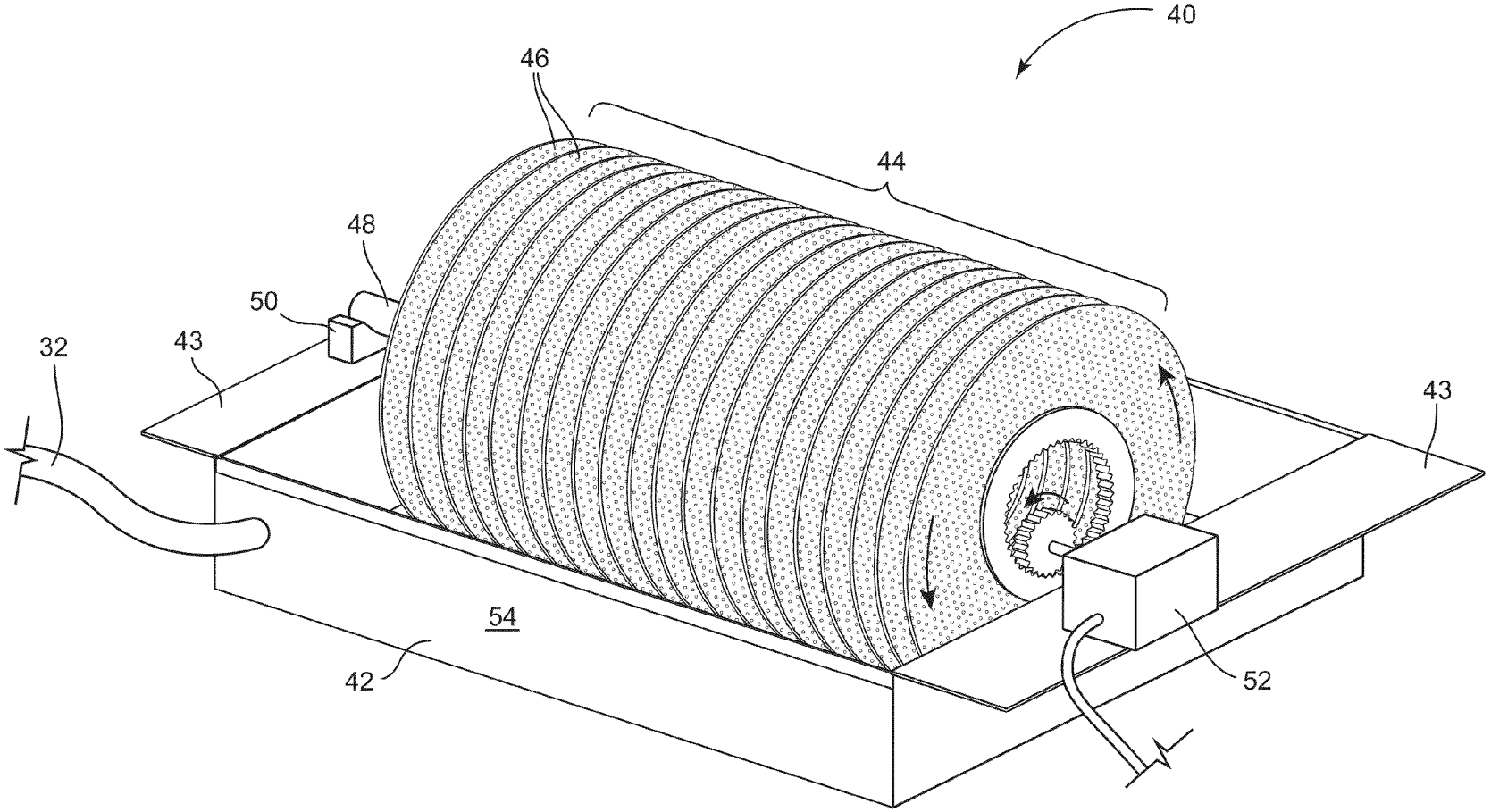
FIG. 2C is a drawing illustrating the evaporative condensate dissipation system of FIG. 1 in greater detail, according to another exemplary embodiment in which the array of rotating plates has a central opening with gear teeth around an inner perimeter surface of the central opening for rotatably coupling the array of plates to the motor.
Figure 3:
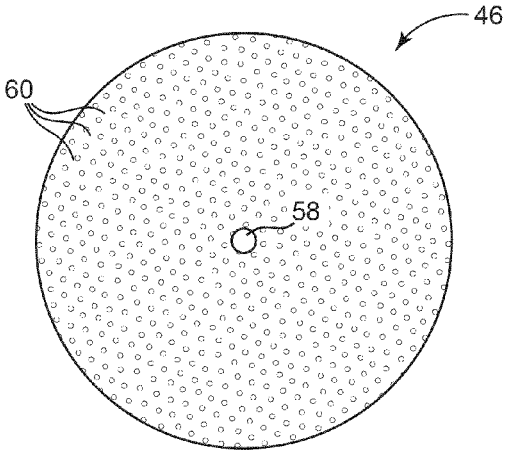
FIG. 3 is a drawing illustrating one of the plates in the array of rotating plates in greater detail, according to an exemplary embodiment.
Figure 4:
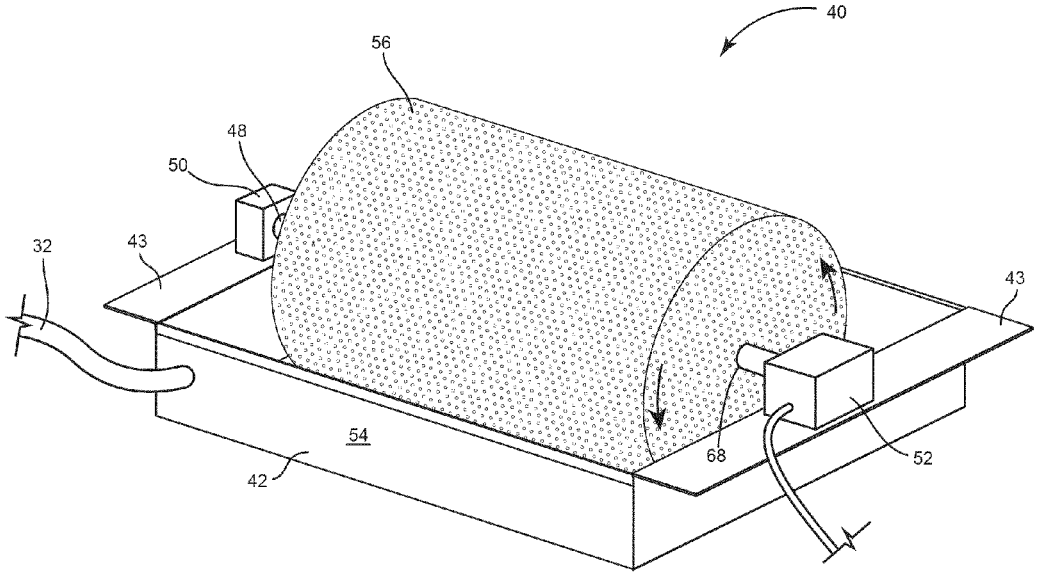
FIG. 4 is a drawing illustrating the evaporative condensate dissipation system of FIG. 1 in greater detail, according to another exemplary embodiment in which the evaporative condensate dissipation system includes a rotating drum.
Figure 5:
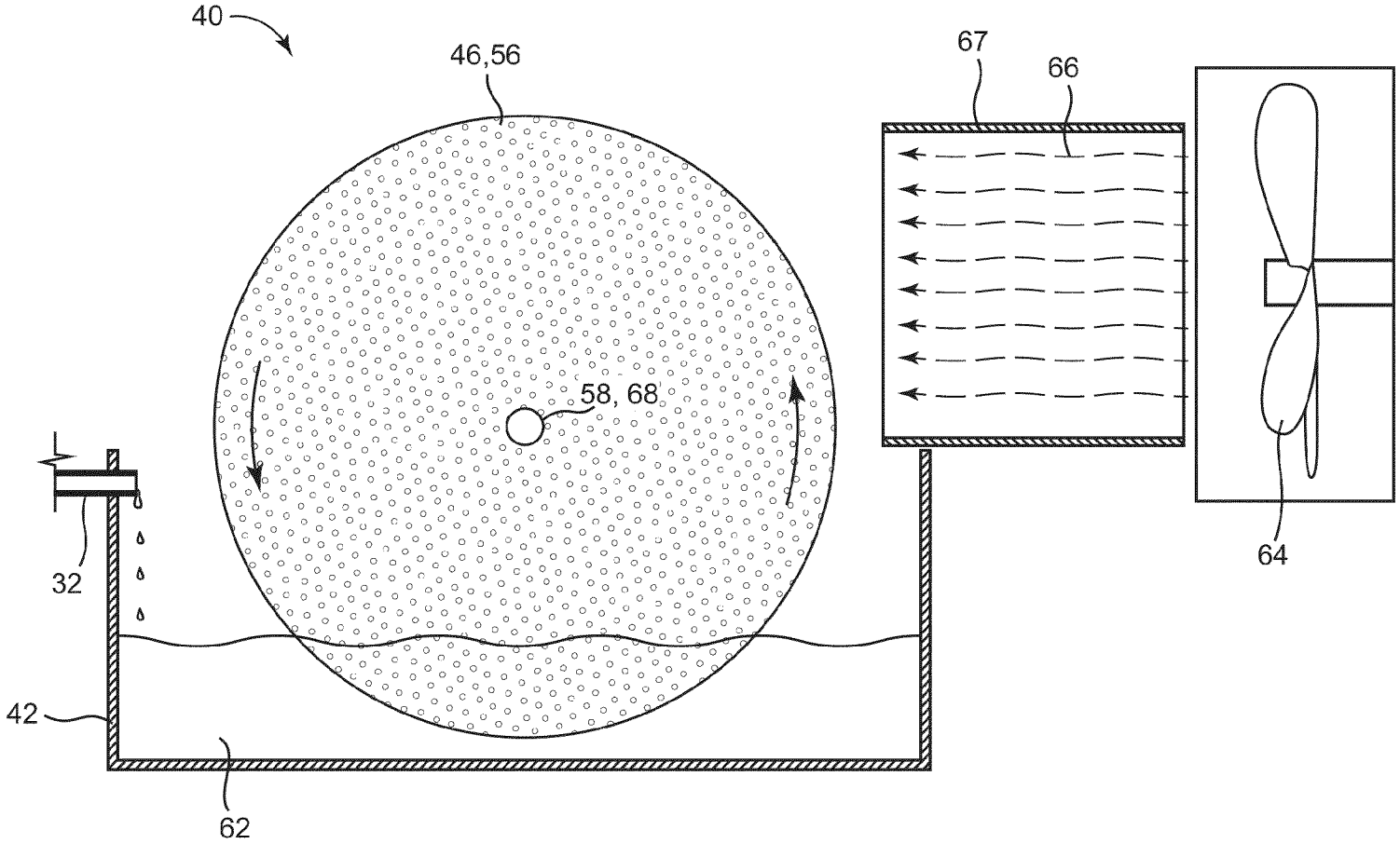
FIG. 5 is a cross-sectional drawing of the evaporative condensate dissipation system shown in FIGS. 2A-2C and FIG. 4, according to an exemplary embodiment.

Referring now to FIGS. 2A-5, evaporative condensate dissipation system 40 is shown in greater detail, according to an exemplary embodiment. Evaporative condensate dissipation system 40 is configured to receive a liquid condensate (e.g. liquid water, melted frost, melted ice, etc.) from an external surface of cooling element 22 and to dissipate the liquid condensate by evaporation. In brief overview, FIGS. 2A-3 illustrate a first exemplary embodiment of system 40 in which a rotating array of plates is used for evaporative dissipation; FIG. 4 illustrates a second exemplary embodiment of system 40 in which a rotating cylinder is used for evaporative dissipation; and FIG. 5 illustrates a cross-sectional view of system 40 according to either of the embodiments shown in FIGS. 2A-4.

Evaporative condensate dissipation system 40 is shown to include a receptacle 42. Receptacle 42 may be a water accumulation pan configured to receive and contain the liquid condensate from cooling element 22. In some embodiments, the liquid condensate from cooling element 22 drips directly into receptacle 42 from cooling element 22 (e.g., for embodiments in which receptacle 42 is disposed directly below cooling element 22). In other embodiments, receptacle 42 receives the liquid condensate via a drain line 32. Drain line 32 may be configured to receive the liquid condensate from a drain pan 30 positioned below cooling element 22 and to deliver the liquid condensate to receptacle 42. In various embodiments, drain line 32 may deliver the liquid condensate through an opening in a side wall 54 of receptacle 42 (as shown in FIG. 2A) or via an open top of receptacle 42. For example, drain line 32 may have a lower end positioned above receptacle 42 such that the liquid condensate can drop from the lower end of drain line 32 into receptacle 42. In some embodiments, the outside surface of receptacle 42 includes fins 43 or other heat transfer enhancing structure to improve heat transfer from the ambient environment to the liquid condensate.

Referring specifically to FIGS. 2A-2B, evaporative condensate dissipation system 40 is shown to include a rotating array 44. In some embodiments, array 44 is used as a rotating element for evaporative dissipation. Array 44 is shown to include a plurality of plates 46 attached to an axle 48. In some embodiments, plates 46 are fixed to axle 48 such that a rotation of axle 48 causes a corresponding rotation of plates 46. Plates 46 are shown as circular discs arranged in parallel and concentrically aligned along axle 48.

Axle 48 may be supported by a saddle 50 at a first end and coupled to a motor 52 at a second end opposite the first end. Saddle 50 may allow for axial rotation while constraining the first end of axle 48 from vertical or horizontal translation. Motor 52 may be configured to rotate axle 48 about an axis of rotation extending longitudinally through axle 48. The axis of rotation of axle 48 may be parallel to the surface of the liquid condensate in receptacle 42. Axle 48 may be rotatably coupled with motor 52 in a direct manner (as shown in FIG. 2A) or via a gearing arrangement (shown in FIG. 2B). In some embodiments, axle 48 is formed by interlocking multiple plates 46. Each of plates 46 may be affixed to a segment of axle 48. The axle segments may be configured to interconnect, thereby forming a longer axle 48.

Referring specifically to FIG. 2C, array 44 is shown with a central opening rather than a central axle. An inner perimeter of the central opening may have a ring gear affixed thereto (e.g., with gear teeth facing inward toward an axis of rotation of array 44). In various embodiments, the gear teeth may face inward or outward. A rotary gear attached to motor 52 may be configured to mesh with the ring gear to rotatably couple array 44 with motor 52. Plates 46 may be secured to each other via engagement features (e.g., snaps, fittings, etc.) extending between discs. The engagement features may extend from the ring gear or from the planar surfaces of plates 46. This arrangement allows for plates 46 to be added or removed individually to adjust the size of array 44.

In some embodiments, motor 52 is activated in response to the liquid condensate in receptacle 42 exceeding a threshold level. For example, receptacle 42 may include a float switch or other sensor capable of measuring or indicating a level (e.g., depth, mass, volume, etc.) of the liquid condensate accumulated in receptacle 42. When the level of the liquid condensate exceeds a threshold level, motor 52 may be activated to increase the rate of evaporative dissipation (e.g., by rotating array 44).

In some embodiments, plates 46 are thin discs having a thickness t. Plates 46 may be offset from each other by an offset distance $d_o$ (i.e., a distance between adjacent plates 46). The offset distance $d_o$ may be substantially uniform between each of plates 46 or may vary between adjacent plates 46. In some embodiments, the offset distance $d_o$ is between the plate thickness and fifty times the plate thickness (i.e., $t \leq d_o \leq 50t$). In some embodiments, the offset distance $d_o$ is between the plate thickness and ten times the plate thickness (i.e., $t \leq d_o \leq 10t$). In an exemplary embodiment, the offset distance $d_o$ is approximately five times the plate thickness (i.e., $d_o \approx 5t$).

Referring specifically to FIG. 3, a single plate 46 is shown, according to an exemplary embodiment. Plate 46 is shown to include a central opening 58. Axle 48 may extend through the central openings 58 of each of plates 46. An inner circumferential surface of central opening 58 may be secured to an outer circumferential surface of axle 48 (e.g., by an adhesive, by a press fitting, by a geometric fitting, etc.) to fix plates 46 to axle 48.

In some embodiments, plates 46 are perforated. For example, plate 46 is shown to include a plurality of satellite holes 60 extending through the thickness of plate 46. Satellite holes 60 may rotate about central opening 58 as plate 46 rotates about axle 48. In various embodiments, holes 60 may be circular (as shown in FIG. 3), hexagonal, rectangular, or have any other shape or size. In some embodiments, plate 46 has a honeycomb structure including a plurality of hexagonal holes separated by dividing walls.

As shown in FIG. 5, plates 46 may be partially submerged in the liquid condensate 62 accumulated in receptacle 42. In some embodiments, the depth of receptacle 42 may be approximately equal (e.g., within 25%, within 10%, within 5%, etc.) to the radius of plate 46 such that approximately half of each plate 46 can be submerged in liquid condensate 62. As plates 46 are rotated, a portion of plates 46 may be periodically submerged in liquid condensate 62 (e.g., at a bottom of the rotational path) and emerged from liquid condensate 62 (e.g., at a top of the rotational path). As plates 46 are rotated, the surfaces of plates 46 may become wetted as a result of the periodic submersion in liquid condensate 62.

In some embodiments, satellite holes 60 are shaped and/or sized to effectively retain drops of water as plate 46 rotates about axle 48. For example satellite holes 60 may have a diameter $d_s$ between half a millimeter and five millimeters (i.e., 0.5 mm$\leq d_s \leq$5 mm) such that the surface tension of water is sufficient to retain drops of water within satellite holes 60. In some embodiments, plates 46 are made from a material that absorbs moisture and/or wicks moisture from an edge of plates 46 toward central opening 58. Advantageously, the increase in wetted surface area (relative to the surface area of liquid condensate 62 in receptacle 42) provided by the plates 46 facilitates an expedited evaporative dissipation of liquid condensate 62.

Referring now to FIG. 4, evaporative condensate dissipation system 40 is shown to include a rotating drum 56. In some embodiments, drum 56 is used as a rotating element for evaporative dissipation in place of plates 46. Drum 56 may be fixed to axle 48 such that a rotation of axle 48 causes a corresponding rotation of drum 56. Drum 56 is shown as a cylinder having a longitudinal axis aligned with axle 48. In some embodiments, drum 56 includes a central opening 68. Axle 48 may extend through the central opening 68. An inner circumferential surface of central opening 68 may be secured to an outer circumferential surface of axle 48 (e.g., by an adhesive, by a press fitting, by a geometric fitting, etc.) to fix drum 56 to axle 48.

Referring now to FIG. 5, drum 56 may be partially submerged in the liquid condensate 62 accumulated in receptacle 42. In some embodiments, the radius of drum 56 may be approximately equal (e.g., within 25%, within 10%, within 5%, etc.) to the depth of receptacle 42 such that approximately half of drum 56 can be submerged in liquid condensate 62. As drum 56 is rotated, a portion of drum 56 may be periodically submerged in liquid condensate 62 (e.g., at a bottom of the rotational path) and emerged from liquid condensate 62 (e.g., at a top of the rotational path). As drum 56 is rotated, the circumferential surface of drum 56 may become wetted as a result of the periodic submersion in liquid condensate 62. In some embodiments, drum 56 may be porous (e.g., having a plurality of satellite holes) and/or made from a material that absorbs moisture. Advantageously, the increase in wetted surface area (relative to the surface area of liquid condensate 62 in receptacle 42) provided by drum 56 facilitates an expedited evaporative dissipation of liquid condensate 62.

FIG. 5 illustrates a cross-sectional view of evaporative condensate dissipation system 40, according to an exemplary embodiment. The rotating element shown in FIG. 5 may be a single plate 46, an array 44 of plates, or drum 56. Liquid condensate 62 may be delivered to system 40 (e.g., via drain line 32) and may accumulate in receptacle 42. As liquid condensate 62 accumulates in receptacle 42, the rotating element (e.g., plates 46 and/or drum 56) may be partially submerged in liquid condensate 62. In some embodiments, receptacle 42 includes a float switch or other sensor configured to indicate an amount of the liquid condensate 62 that has accumulated in receptacle 42.

In some embodiments, evaporative condensate dissipation system 40 includes a fan 64. Fan 64 may be an existing component of refrigeration system 20 or an additional component. For example, fan 64 may be a compressor fan (e.g., for compressor 24), a condenser fan, or another fan configured to cause air movement for refrigeration system 20. Fan 64 may be configured to cause airflow 66 across plates 46 (e.g., between plates 46) and/or across a circumferential surface of drum 56. In some embodiments, ducting 67 may be used to concentrate airflow 66 across the rotating element 46 or 56. The airflow 66 provided by fan 64 may increase an evaporative dissipation rate of liquid condensate 62. In some embodiments, fan 64 is activated in response to the liquid condensate 62 exceeding a threshold level in receptacle 42 (e.g., triggering a float switch that powers fan 64).

In some embodiments, evaporative condensate dissipation system 40 uses heat generated by the compressor 24 or condenser of refrigeration system 20 to increase the rate of evaporative dissipation of liquid condensate 62. Receptacle 42 may be located near (e.g., above, adjacent to, etc.) or integrated with a heat-rejecting heat exchanger of refrigeration system 20 such that heat rejected by the heat-rejecting heat exchanger is transferred at least partially into the liquid condensate 62 in receptacle 42. For example, the airflow 66 caused by fan 64 may be heated using heat from compressor 24 or from a condenser of refrigeration system 20. The heated airflow 66 may be provided to evaporative condensate dissipation system 40 via fan 64 and used to expedite the rate of evaporative dissipation.

Figure 8:
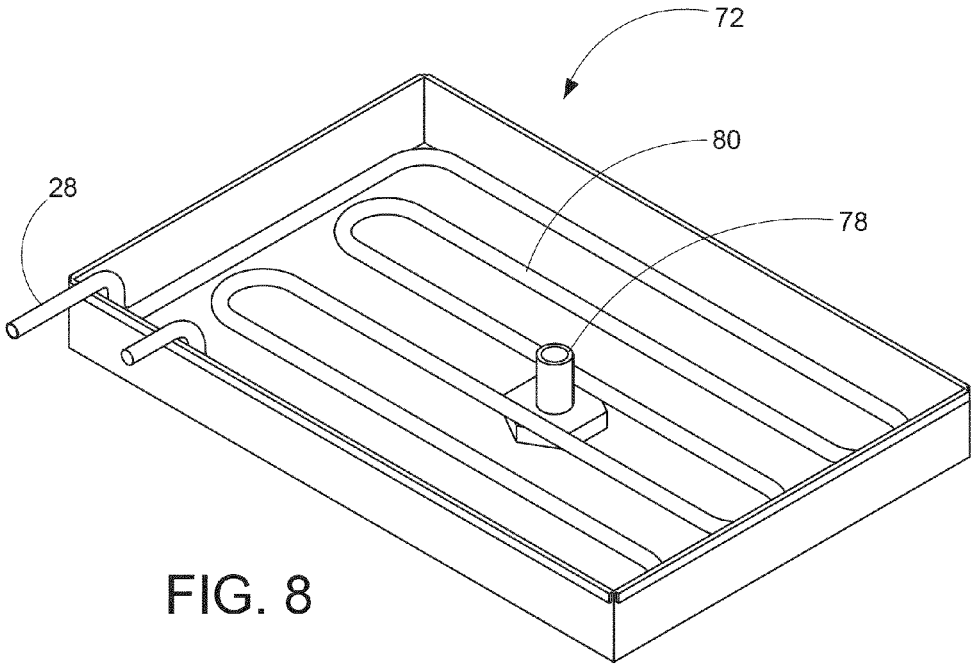
FIG. 8 is a drawing illustrating another of the stages of the cascaded arrangement of FIGS. 6A-6B in greater detail, according to an exemplary embodiment.

In some embodiments, receptacle 42 includes a heat exchanger (e.g., a coil, fin-coil, tubing arrangement, passages formed within a wall or base of receptacle 42, etc.) that receives a supply of hot gas refrigerant from the discharge line 28 of compressor 24 as a source of heating for the liquid condensate 62. An example of such an arrangement is shown in FIG. 8. The heat exchanger may include tubing (e.g., flex hoses, etc.) with quick-connect couplings 53 (shown in FIG. 1) to engage corresponding portions of the compressor discharge line 28. In some embodiments, the heat exchanger is at least partially submerged in liquid condensate 62. The hot gas refrigerant may raise the temperature of liquid condensate 62 in receptacle 42. After passing through the heat exchanger, the hot gas refrigerant may be routed to the condenser in a pre-cooled (or at least partially de-superheated) state. Advantageously, pre-cooling the hot gas refrigerant by transferring heat into liquid condensate 62 may provide an increased rate of evaporative dissipation in receptacle 42 while enhancing the overall efficiency of refrigeration system 20.

Figure 6A:
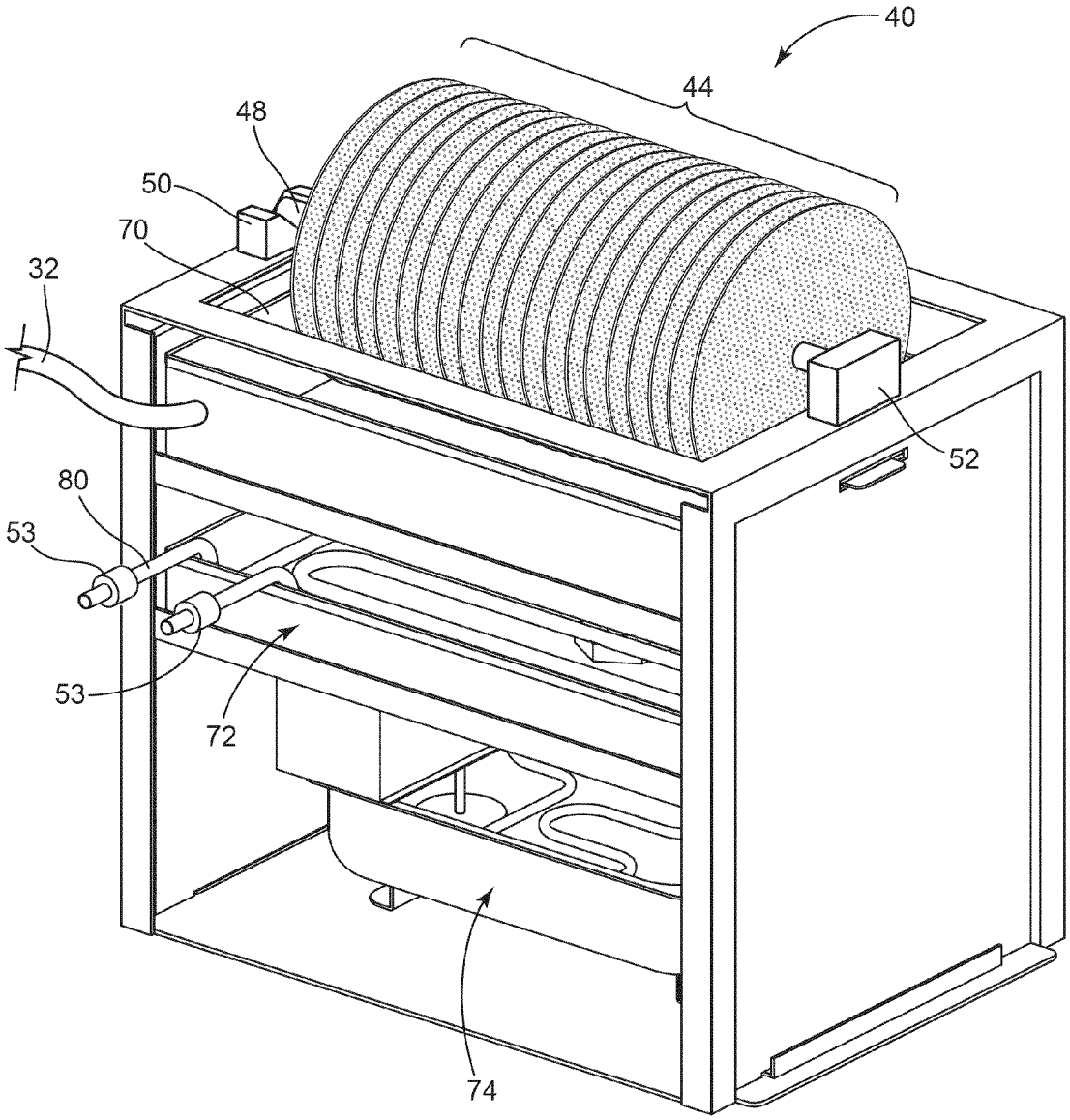
FIG. 6A is a drawing illustrating the evaporative condensate dissipation system of FIG. 1 in greater detail, according to an exemplary embodiment in which the evaporative condensate dissipation system includes a cascaded arrangement of multiple stages.

Referring now to FIGS. 6A-9, evaporative condensate dissipation system 40 is shown, according to another exemplary embodiment. In some embodiments, system 40 includes a series of catch-containment stages that provide a cascading back-up arrangement for evaporative dissipation. Each stage may operate at a progressively increasing temperature to provide a progressively overall increased evaporative dissipation at each successive stage. As shown in FIGS. 6A-6B, each stage may include a receptacle (e.g., a container, a pan, etc.) for collecting the liquid condensate. For example, evaporative condensate dissipation system 40 is shown to include a first stage receptacle 70, a second stage receptacle 72, and a third stage receptacle 74.

Each of receptacles 70 and 72 may include an overflow device configured to direct any overflow of the liquid condensate to the next stage of the cascading arrangement. If a rate of accumulation of the liquid condensate in first stage receptacle 70 exceeds a rate at which the liquid condensate can be evaporated in the first stage of the cascading arrangement, the liquid condensate may overflow from first stage receptacle 70 to second stage receptacle 72. Similarly, if a rate of accumulation of the liquid condensate in second stage receptacle 72 exceeds a rate at which the liquid condensate can be evaporated in the second stage of the cascading arrangement, the liquid condensate may overflow from second stage receptacle 72 to third stage receptacle 74.

Referring specifically to FIG. 6A, first stage receptacle 70 may be combined with a rotating element (e.g., rotating array 44, rotating drum 56, etc.) as previously described with reference to FIGS. 2A-5 to provide an increased rate of evaporative dissipation in first stage receptacle 70. Axle 48 may be supported above first stage receptacle 70 (e.g., by saddle 50 and motor 52) such that the rotating element is partially submerged in the liquid condensate accumulated in first stage receptacle 70. In some embodiments, first stage receptacle 70 is positioned above second stage receptacle 72 to facilitate the cascading arrangement in which the liquid condensate from first stage receptacle 70 overflows to second stage receptacle 72. Similarly, second stage receptacle 72 may be positioned above third stage receptacle 74 to facilitate overflow from second stage receptacle 72 to third stage receptacle 74.

Figure 6B:
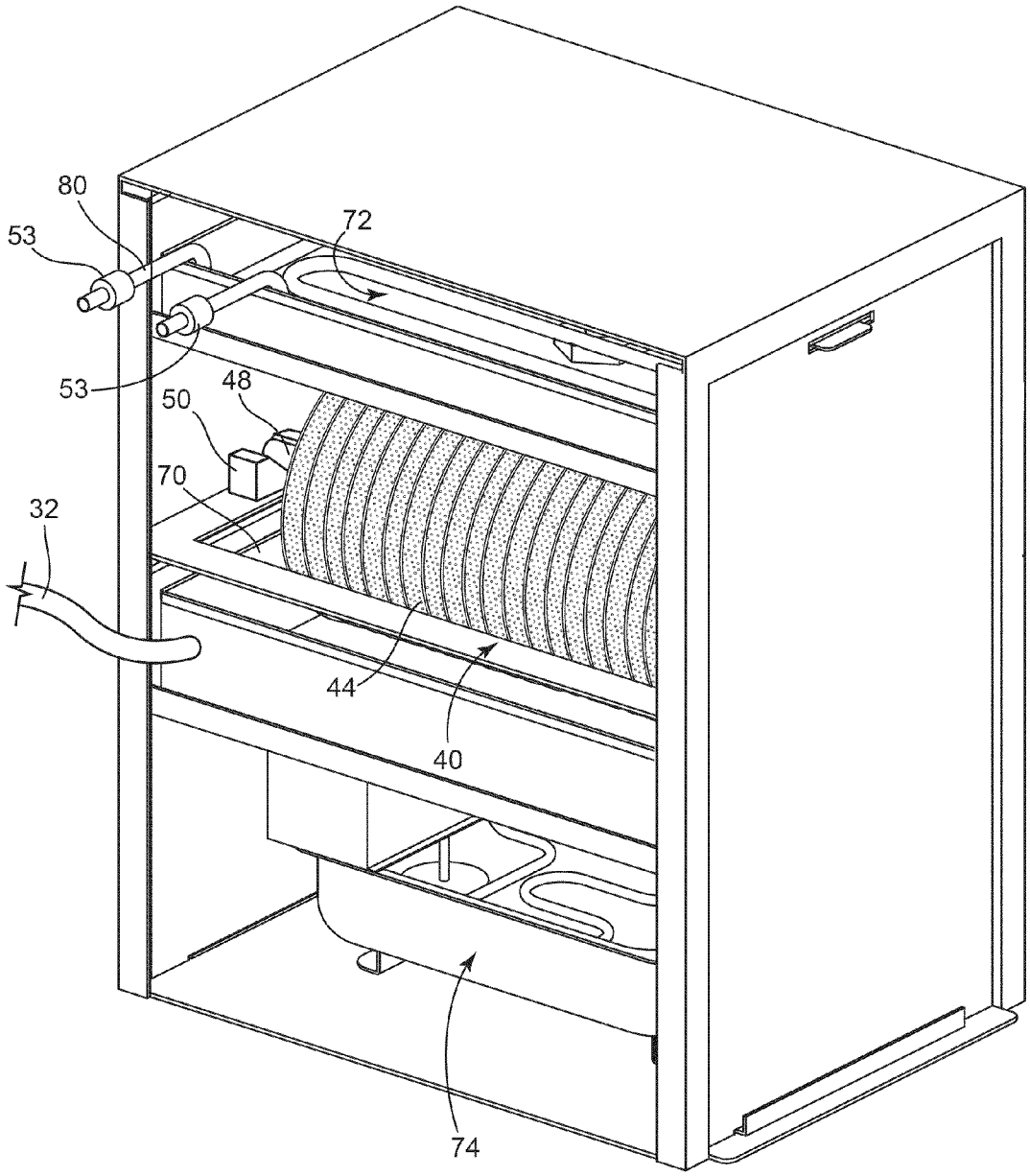
FIG. 6B is a drawing illustrating the evaporative condensate dissipation system of FIG. 1 in greater detail, according to an exemplary embodiment in which the array of rotating plates forms the second stage of the evaporative condensate dissipation system.

Referring specifically to FIG. 6B, in some embodiments, receptacle 72 may be the first stage receptacle and receptacle 70 may be the second stage receptacle. Receptacle 72 may be positioned above receptacle 70 to facilitate the cascading arrangement in which the liquid from receptacle 72 overflows to receptacle 70. Receptacle 70 may be positioned above receptacle 74 to facilitate overflow from receptacle 70 to receptacle 74.

Figure 7:
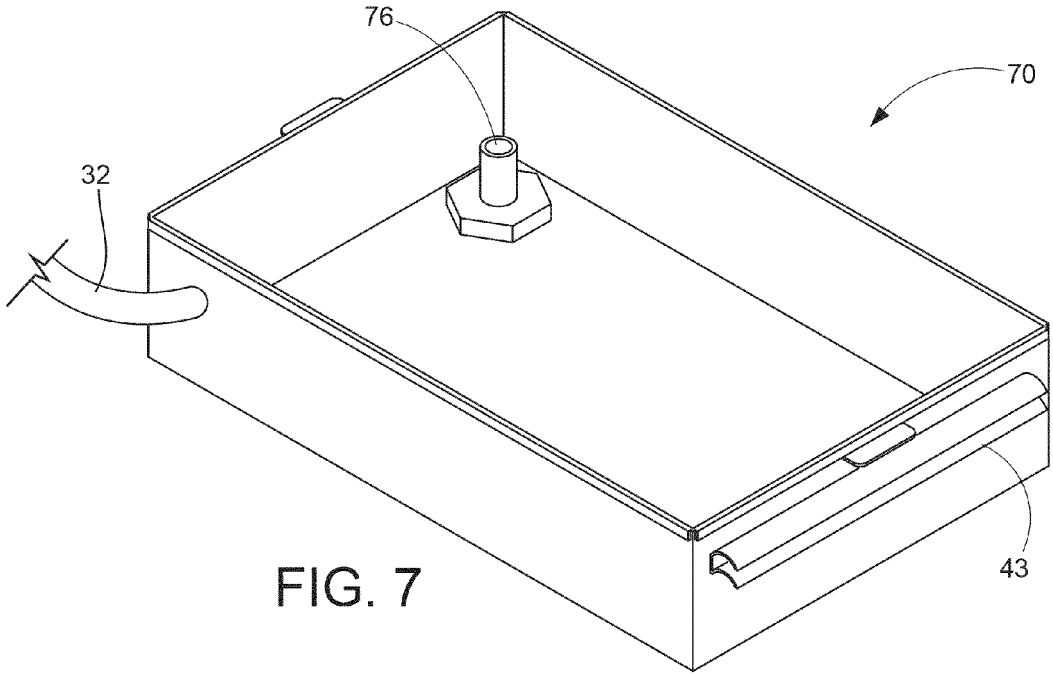
FIG. 7 is a drawing illustrating one of the stages of the cascaded arrangement of FIGS. 6A-6B in greater detail, according to an exemplary embodiment.

Referring specifically to FIG. 7, first stage receptacle 70 is shown in greater detail, according to an exemplary embodiment. In some embodiments, first stage receptacle 70 is the same or similar to receptacle 42 as previously described with reference to FIGS. 2A-5. For example, first stage receptacle 70 may be a water accumulation pan configured to receive and contain the liquid condensate from cooling element 22. In some embodiments, the liquid condensate from cooling element 22 drips directly into first stage receptacle 70 from cooling element 22 (e.g., for embodiments in which receptacle 70 is disposed directly below cooling element 22). In other embodiments, first stage receptacle 70 receives the liquid condensate via drain line 32. Drain line 32 may be configured to receive the liquid condensate from a drain pan 30 positioned below cooling element 22 and to deliver the liquid condensate to first stage receptacle 70. In various embodiments, drain line 32 may deliver the liquid condensate through an opening in a side wall of first stage receptacle 70 (as shown in FIG. 7) or via an open top of first stage receptacle 70.

The liquid condensate entering first stage receptacle 70 may have a temperature corresponding to the operating temperature of cooling element 22. For implementations in which cooling element 22 operates at a temperature below the freezing temperature of water, the liquid condensate may be melted from cooling element 22 and delivered to first stage receptacle 70 at a temperature slightly above approximately 32° F. The liquid condensate in first stage receptacle 70 may be allowed to warm-up in first stage receptacle 70 to a first stage temperature that is approximately equal to the ambient temperature of the environment surrounding temperature-controlled display device 10 (e.g. approximately 75° F. in a store environment, etc.). In some embodiments, the outside surface of first stage receptacle 70 may include fins 43 or other heat transfer enhancing structure to improve heat transfer from the ambient environment to the liquid condensate. As the temperature of the liquid condensate at the first stage approaches the first stage temperature (e.g. ambient temperature), a first evaporative dissipation occurs to dissipate the contained liquid condensate to the ambient atmosphere. In the event that the rate of collection of liquid condensate in first stage receptacle 70 exceeds the first evaporative dissipation rate, the second stage of system 40 is available.

First stage receptacle 70 is shown to include a first overflow device 76. First overflow device 76 may be a standpipe (as shown in FIG. 7), a weir, an opening in a side of first stage receptacle 70, or any other device configured to drain an overflow of the liquid condensate from first stage receptacle 70 when the level of liquid condensate exceeds a maximum level. The maximum level of liquid condensate in first stage receptacle 70 may be defined by the position and/or height of first overflow device 76. For example, when the level of liquid condensate in first stage receptacle 70 reaches the top of first overflow device 76, the excess liquid condensate may flow through an opening in the top of first overflow device 76 and drain into second stage receptacle 72. In some embodiments, first overflow device 76 is located in a corner of first stage receptacle 70 to allow the rotating element (i.e., rotating array 44 or rotating drum 56) to be installed in first stage receptacle 70 (as shown in FIG. 6A).

Referring now to FIG. 8, second stage receptacle 72 is shown in greater detail, according to an exemplary embodiment. Second stage receptacle 72 may be another water accumulation pan configured to contain the liquid condensate. Second stage receptacle 72 may be disposed at a lower elevation than first stage receptacle 70 and may receive the liquid condensate from first stage receptacle 70 (e.g. by gravity) when the level of the liquid condensate in first stage receptacle 70 reaches first overflow device 76. Any overflow from first stage receptacle 70 may be captured by second stage receptacle 72.

In some embodiments, second stage receptacle 72 is substantially vertically aligned beneath first stage receptacle 70. Such a vertical alignment may facilitate a compact packaging of system 40 and may allow for a gravity-feed of the liquid condensate from first stage receptacle 70 to second stage receptacle 72. In other embodiments, second stage receptacle 72 may not be directly beneath first stage receptacle 70. For embodiments in which second stage receptacle 72 is not directly below first stage receptacle 70, a tube or drain line may be used to direct the liquid condensate from first overflow device 76 into second stage receptacle 72.

In some embodiments, second stage receptacle 72 includes a heat exchanger 80. Heat exchanger 80 may include a coil, a fin-coil, a tubing arrangement, passages formed within a wall or base of second stage receptacle 72, or other structures capable of containing and/or routing a fluid refrigerant. Heat exchanger 80 may be a heat-rejecting heat exchanger that receives a supply of hot gas refrigerant from the discharge line 28 of compressor 24. In some embodiments, heat exchanger 80 includes tubing (e.g. flex hoses, etc.) with quick-connect couplings 53 (shown in FIGS. 6A-6B) configured to engage corresponding portions of discharge line 28.

In some embodiments, heat exchanger 80 is at least partially submerged in the liquid condensate in second stage receptacle 72. Heat exchanger 80 may transfer heat from the hot gas refrigerant to the liquid condensate. After passing through heat exchanger 80, the hot gas refrigerant may be routed to the condenser in a pre-cooled (or at least partially de-superheated) state. Advantageously, pre-cooling the hot gas refrigerant by transferring heat into the liquid condensate in second stage receptacle 72 may provide an increased rate of evaporative dissipation in second stage receptacle 72 while enhancing the overall efficiency of refrigeration system 20.

The heat provided by heat exchanger 80 may raise the temperature of the liquid condensate in second stage receptacle 72 to a second stage temperature. The second stage temperature may be higher than the first stage temperature and may result in a second evaporative dissipation to dissipate the liquid condensate in second stage receptacle 72 to the ambient atmosphere. In the event that the rate of collection of liquid condensate generation from cooling element 22 exceeds the first and second evaporative dissipation rates, the third stage of system 40 is available.

Second stage receptacle 72 is shown to include a second overflow device 78. Second overflow device 78 may be a standpipe (as shown in FIG. 8), a weir, an opening in a side of second stage receptacle 72, or any other device configured to drain an overflow of the liquid condensate from second stage receptacle 72 when the level of liquid condensate exceeds a maximum level. The maximum level of liquid condensate in second stage receptacle 72 may be defined by the position and/or height of second overflow device 78. For example, when the level of liquid condensate in second stage receptacle 72 reaches the top of second overflow device 78, the excess liquid condensate may flow through an opening in the top of second overflow device 78 and drain into third stage receptacle 74.

Figure 9:
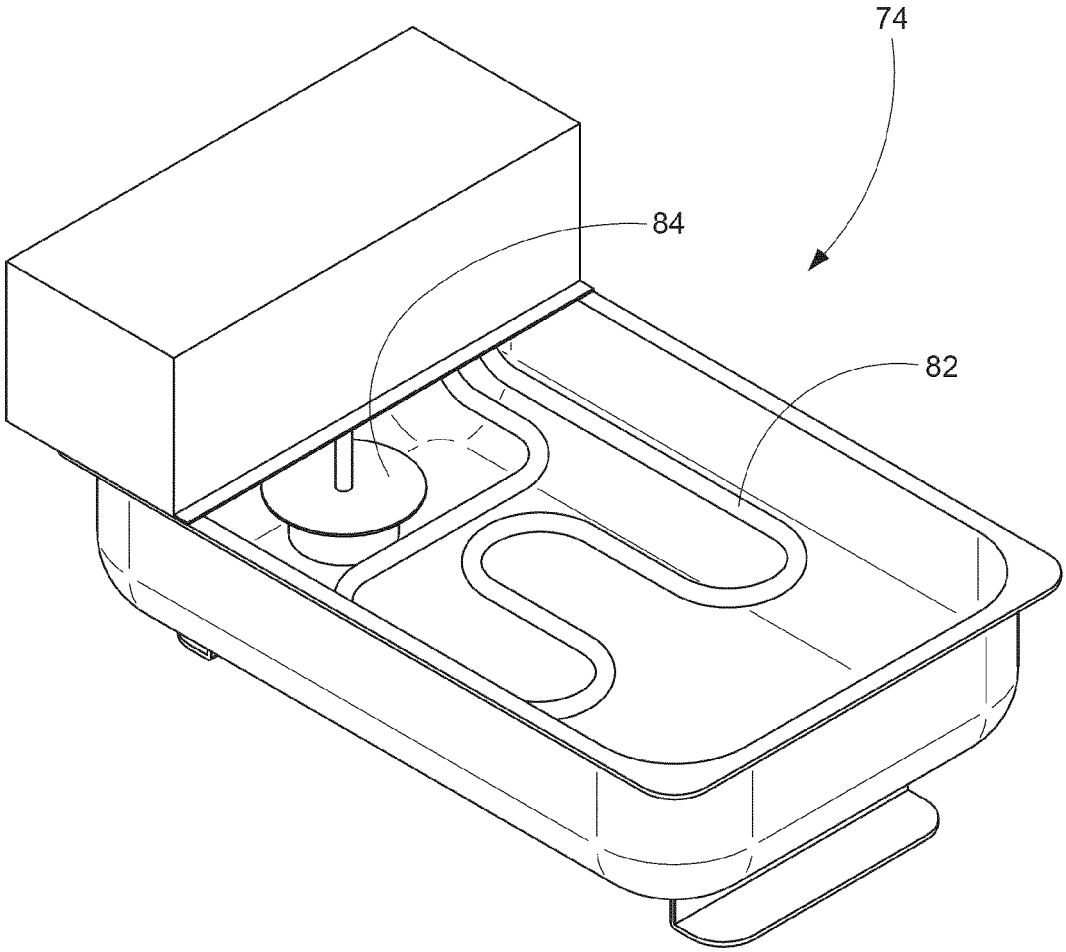
FIG. 9 is a drawing illustrating another of the stages of the cascaded arrangement of FIGS. 6A-6B in greater detail, according to an exemplary embodiment.

Referring now to FIG. 9, third stage receptacle 74 is shown in greater detail, according to an exemplary embodiment. Third stage receptacle 74 may be another water accumulation pan configured to contain the liquid condensate. Third stage receptacle 74 may be disposed at a lower elevation than second stage receptacle 72 and may receive the liquid condensate from second stage receptacle 72 (e.g. by gravity) when the level of the liquid condensate in second stage receptacle 72 reaches second overflow device 78. Any overflow from second stage receptacle 72 may be captured by third stage receptacle 74.

In some embodiments, third stage receptacle 74 is substantially vertically aligned beneath first stage receptacle 70 and second stage receptacle 72. Such a vertical alignment may facilitate a compact packaging of system 40 and may allow for a gravity-feed of the liquid condensate from second stage receptacle 72 to third stage receptacle 74. In other embodiments, third stage receptacle 74 may not be directly beneath first stage receptacle 70 and/or second stage receptacle 72. For embodiments in which third stage receptacle 74 is not directly below second stage receptacle 72, a tube or drain line may be used to direct the liquid condensate from second overflow device 78 into third stage receptacle 74.

Third stage receptacle 74 is shown to include a heating element 82. Heating element 82 may be an electric heating element configured to provide a source of heating for the liquid condensate in third stage receptacle 74. Heating element 82 may be controlled (e.g., actuated, turned on/off, modulated, etc.) by a switch 84 that is responsive to the level of liquid condensate in third stage receptacle 74. For example, switch 84 may be a float switch, a level switch, a sensor, or any other device responsive to the level (e.g., depth, volume, mass, etc.) of liquid condensate in third stage receptacle 74. In some embodiments, switch 84 is configured to activate heating element 82 when the level of liquid condensate in third stage receptacle 74 is above a height of heating element 82 such that heating element 82 is energized only when heating element 82 is submerged in the liquid condensate. Heating element 84 may raise the temperature of the liquid condensate in third stage receptacle 74 to a third stage temperature higher than the second stage temperature. As the liquid condensate approaches the third stage temperature, a third evaporative dissipation may occur to dissipate the liquid condensate to the ambient atmosphere.

The construction and arrangement of the temperature-controlled display device, refrigeration system, and/or evaporative condensate dissipation system as shown in the various exemplary embodiments are illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed herein. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the various exemplary embodiments without departing from the scope of the present inventions.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It should be noted that the orientation of various elements may differ according to other exemplary embodiments, and that such variations are intended to be encompassed by the present disclosure.

No claim element herein is to be construed under the provisions of 35 U.S.C. §112, sixth paragraph, unless the element is expressly recited using the phrase "means for." Furthermore, no element, component or method step in the present disclosure is intended to be dedicated to the public, regardless of whether the element, component or method step is explicitly recited in the claims.

What is claimed is:

1. An evaporative condensate dissipation system comprising:

a receptacle configured to receive and accumulate a liquid condensate from a cooling element of a refrigeration system;

a rotating element disposed at least partially within the receptacle such that a portion of the rotating element is submerged in the liquid condensate accumulated in the receptacle;

a motor configured to cause the rotating element to rotate such that a portion of the rotating element is periodically submerged in the liquid condensate accumulated in the receptacle and emerged from the liquid condensate accumulated in the receptacle; and an axle;

wherein the receptacle and the rotating element are configured to contain the liquid condensate accumulated in the receptacle until the liquid condensate accumulated in the receptacle dissipates by evaporation within the rotating element and the receptacle;

wherein the axle is fixedly attached to the rotating element such that rotation of the axle causes a corresponding rotation of the rotating element; and wherein the rotating element comprises one or more plates arranged in parallel and concentrically aligned along the axle;

wherein the one or more plates are fixed to the axle and configured to rotate about an axis of rotation defined by the axle;

wherein the axis of rotation is substantially parallel to an upper surface of the liquid condensate accumulated in the receptacle.

2. The evaporative condensate dissipation system of claim 1, further comprising:

a bearing attached to the receptacle;

wherein the axle comprises a first end supported by the bearing, a second end rotatably coupled to the motor, and a middle portion extending between the bearing and the motor over the liquid condensate accumulated in the receptacle.

3. The evaporative condensate dissipation system of claim 1, wherein each of the one or more plates comprises:

a central opening configured to fix the plate to the axle, wherein the axle extends through the central opening; and a plurality of satellite holes configured to rotate about the central opening as the plate rotates about the axis of rotation.

4. The evaporative condensate dissipation system of claim 1, further comprising:

a sensor configured to indicate a level of the liquid condensate accumulated in the receptacle;

wherein the motor is operably controlled in response to the level of the liquid condensate indicated by the sensor.

5. The evaporative condensate dissipation system of claim 1, further comprising:

a fan configured to cause an airflow across a surface of the rotating element.

6. The evaporative condensate dissipation system of claim 1, further comprising:

a heat exchanger configured to receive a hot gas refrigerant supply from a compressor of the refrigeration system and to transfer heat from the hot gas refrigerant supply into the liquid condensate accumulated in the receptacle.

7. The evaporative condensate dissipation system of claim 1, wherein the one or more plates are substantially circular discs.

8. The evaporative condensate dissipation system of claim 1, wherein the rotating element comprises one or more plates;

wherein the one or more plates interlock to form the axle and the one or more plates are configured to rotate about an axis of rotation defined by the axle;

wherein the axis of rotation is substantially parallel to an upper surface of the liquid condensate accumulated in the receptacle.

9. The evaporative condensate dissipation system of claim 1, further comprising a fin coupled to the receptacle;

wherein the fin is configured to improve heat transfer from an ambient environment surrounding the receptacle to the liquid condensate accumulated in the receptacle.

10. The evaporative condensate dissipation system of claim 1, further comprising a heat transfer structure coupled to the receptacle;

wherein the heat transfer structure is configured to improve heat transfer from an ambient environment surrounding the receptacle to the liquid condensate accumulated in the receptacle.

11. The evaporative condensate dissipation system of claim 1, further comprising a gearing arrangement coupled to the motor and the axle, the gearing arrangement configured to transfer rotation produced by the motor to the axle.

* * * * *